US005876585A

United States Patent [19]

Schenk

[11] Patent Number: 5,876,585

[45] Date of Patent: Mar. 2, 1999

[54] ANODE CLAMP

[76] Inventor: Rodney J. Schenk, 13000 Hwy. 41 South, Robards, Ky. 42452

[21] Appl. No.: 864,210

[22] Filed: May 28, 1997

(Under 37 CFR 1.47)

Related U.S. Application Data

[60] Provisional application No. 60/018,565 May 29, 1996.

[51] Int. Cl. [6] ..... C25C 3/10; C25C 3/16

[52] U.S. Cl. ..... 205/390; 204/245; 204/286; 204/297 R; 204/279

[58] Field of Search ..... 204/279, 286, 204/297 R, 243 R–247; 205/390

[56] References Cited

U.S. PATENT DOCUMENTS

| | | | |
|---|---|---|---|
| 3,627,670 | 12/1971 | Duclaux | 204/243 R X |
| 3,749,661 | 7/1973 | Cook et al. . | |
| 3,888,757 | 6/1975 | Roukema et al. | 204/243 R |
| 3,899,402 | 8/1975 | Chaudhuri . | |
| 4,025,414 | 5/1977 | Vendramini . | |
| 4,229,278 | 10/1980 | Lipschutz . | |
| 4,394,242 | 7/1983 | Clark . | |
| 4,414,070 | 11/1983 | Spence . | |
| 4,465,578 | 8/1984 | Duclaux et al. . | |
| 4,976,841 | 12/1990 | Boivin e tal. . | |

OTHER PUBLICATIONS

Light Metals 1976, Published by the Metallurgical Society of the AIME. (No Month).

*Primary Examiner*—Donald R. Valentine
*Attorney, Agent, or Firm*—Calfee, Halter & Griswold

[57] ABSTRACT

Roller clamps provide an economical and effective means to achieve steady and uniform current distribution through the anodes and cathode of an Hall-Heroult electrolytic cell during the pre-heat cycle. The roller clamps, which replace conventional bar clamps that are used in normal operation, have rollers adapted to bias anode support rods against electrical contacts on an anode bus bar with sufficient pressure to maintain desired electrical contact between the anode and contact; and to permit the anode supports to move to accommodate thermal expansion or deflections of cell components as the cell is heated.

13 Claims, 5 Drawing Sheets

ANODE CLAMP

This application claim the benefit of U.S. Provisional Application No. 60,018,565 filed May 29, 1996.

FIELD OF THE INVENTION

This invention relates to aluminum production and, more particularly, to apparatus for supporting anodes in a Hall-Heroult cell when the cell is placed in operation.

BACKGROUND OF THE INVENTION

Essentially all primary aluminum production takes place in electrolytic cells commonly referred to as Hall-Heroult cells, after the American and French inventors of the process. In these cells, aluminum oxide is dissolved in a bath of molten cryolite, maintained at a temperature of approximately 1,000° C. The aluminum oxide is reduced to metallic aluminum by electric current passing through the bath from carbon anodes suspended in the bath to carbon cathodes that line the bottom of the cells. In the process, the carbon anodes are gradually consumed.

When in operation, these cells are operated 24 hours a day, seven days a week, because of the cost of starting and stopping operation. However, the cells must be shut down periodically to repair or replace the cathodes, to adjust production to meet demand, or for various other reasons.

When a Hall-Heroult cell is started, or restarted, the cell is typically heated by passing electrical current through the cell for 14–24 hours. During this period the cathode temperature is brought from ambient temperature to a temperature of 600°–700°. It is desirable to heat the cathodes, and other cell components, gradually and uniformly over this period to avoid thermal shock to and undue stresses on the cathode blocks from alternating hot and cold areas of the cathode created by uneven distribution of the 10,000 or more KWH applied to heat it.

The life of a cell, i.e. the length of time the cell can be operated before it must be rebuilt again, depends in part on how well the cell is baked-out and started. The life of the individual cell can be reduced by up to 25% by poor bake-out and start-up procedures. With the cost of rebuilding a cell approaching $100,000.00, the need for proper bake-out procedures is obvious.

Increasing cell life also reduces the amount of spent potlining that is generated. Disposal of these wastes is another significant cost.

There is no aluminum or bath in the cell to complete the electric circuit during the pre-heat cycle, and the anode blocks are commonly spaced from the cathodes by resistive carbon containing material between the anode blocks and the cathode. The anodes, cathode, and other components of the cell expand as they are heated. The rods that support the anodes (an individual cell may contain 24 anodes) do not all take current at exactly the same rate, and therefore do not all heat and expand at the same rate. With the rods clamped tightly against the anode bus, in accordance with conventional practice, as one or more rods grow and push up on the cell superstructure, they can and do lift adjacent rods off the resistive material between the anodes and cathode. This accentuates the differences in anode support rod expansion, and creates cool and hot spots in the cathode. The resultant thermal stress may cause cracking of cathode blocks and premature failure of the cell.

In addition, as the cathode begins to heat up, it tends to arch up in the center and middle while each end of the cathode actually moves down. The corner and end anodes can actually be held off the resistive material, while the center or middle anodes push down with the weight of the entire superstructure against the middle cathode blocks, held in place by tamping paste which is now in a plastic state. These forces and stress on the cathode can cause premature cracking and even result in metal infiltration of the cathode, reducing the operating efficiency and shortening the life of the pot or cell.

In a typical prior art cell utilizing 24 anodes per cell, each supported by an anode support rod clamped to a contact button on the anode bus, clamps may be loosened and retightened every hour during the 14–24 hours of the pre-heat cycle. A standard procedure calls for a worker to loosen the clamps on 12 anodes on one side of the cell with a pneumatic impact wrench, retighten all 12, and then repeat the procedure for the 12 anodes on the other side of the cell. This physically demanding work requires an extra worker for each pot that is being pre-heated. The voltage readings on the anode support rods frequently indicate that, in the middle or toward the end of the pre-heat cycle, the anodes actually need to be loosened and retightened more frequently then once per hour.

Systems for supporting anodes in a Hall-Heroult cells so that the anodes can be adjusted individually have been proposed, e.g. in U.S. Pat. No. 4,394,242 to Clark, U.S. Pat. No. 4,414,070 to Spence, and U.S. Pat. No. 4,465,578 to Duclaux et al. Most of these systems are expensive, however, and none provide a mechanism for adjusting the position of a group of anodes in response to thermal expansion of cell components during a pre-heat cycle.

SUMMARY OF THE INVENTION

An object of this invention is to provide improved apparatus for supporting anodes in an electrolytic aluminum production cell while the cell is pre-heated.

A further object is to provide apparatus for clamping anode support rods to a stationary electric supply system during a pre-heat cycle of an aluminum production cell so that the anode support rods can move to accommodate thermal expansion of cell components.

Another object is to provide an economical and effective means to achieve steady and uniform current distribution through the anodes and cathode of an electrolytic cell during the pre-heat cycle.

Another object is to provide apparatus for minimizing the operator intervention required to maintain the pressure that anode blocks exert upon resistive material between the anode blocks and cathode while the cell is heated.

These objects are achieved with a clamp that includes a roller adapted to bias the anode support rod against a stationery electrical supply system contact with sufficient pressure to maintain desired electrical contact between the anode support rod and the contact, but to permit the anode support rod to move to accommodate thermal expansion or deflection of cell components. This allows the anode blocks to move and maintain the desired pressure on the resistive material between the anode blocks and cathode, which makes the electrical contact between the anode blocks, resistive material and cathode largely self-adjusting, thereby minimizing the need for operator intervention.

Yet another object is to provide an economical method and apparatus for clamping anode support rods securely, with conventional clamps, while aluminum is produced in the cells, but to allow the rods to move vertically to accommodate thermal expansion while the cells are heated.

This is accomplished with a temporary clamp member incorporating a roller contact. The conventional bar clamps are replaced by the roller clamps during the pre-heat cycle. The roller clamps allow the anode bars to move up and down to accommodate thermal expansion. Since only a minor fraction of the cells in a pot line or smelter are likely to be started up at any given time, relatively few roller clamps may be used to improve pre-heat performance of a much larger number of cells.

These and other objections of this invention will be apparent from the following detailed description.

DRAWINGS

DETAIL DESCRIPTION

Figure 1:
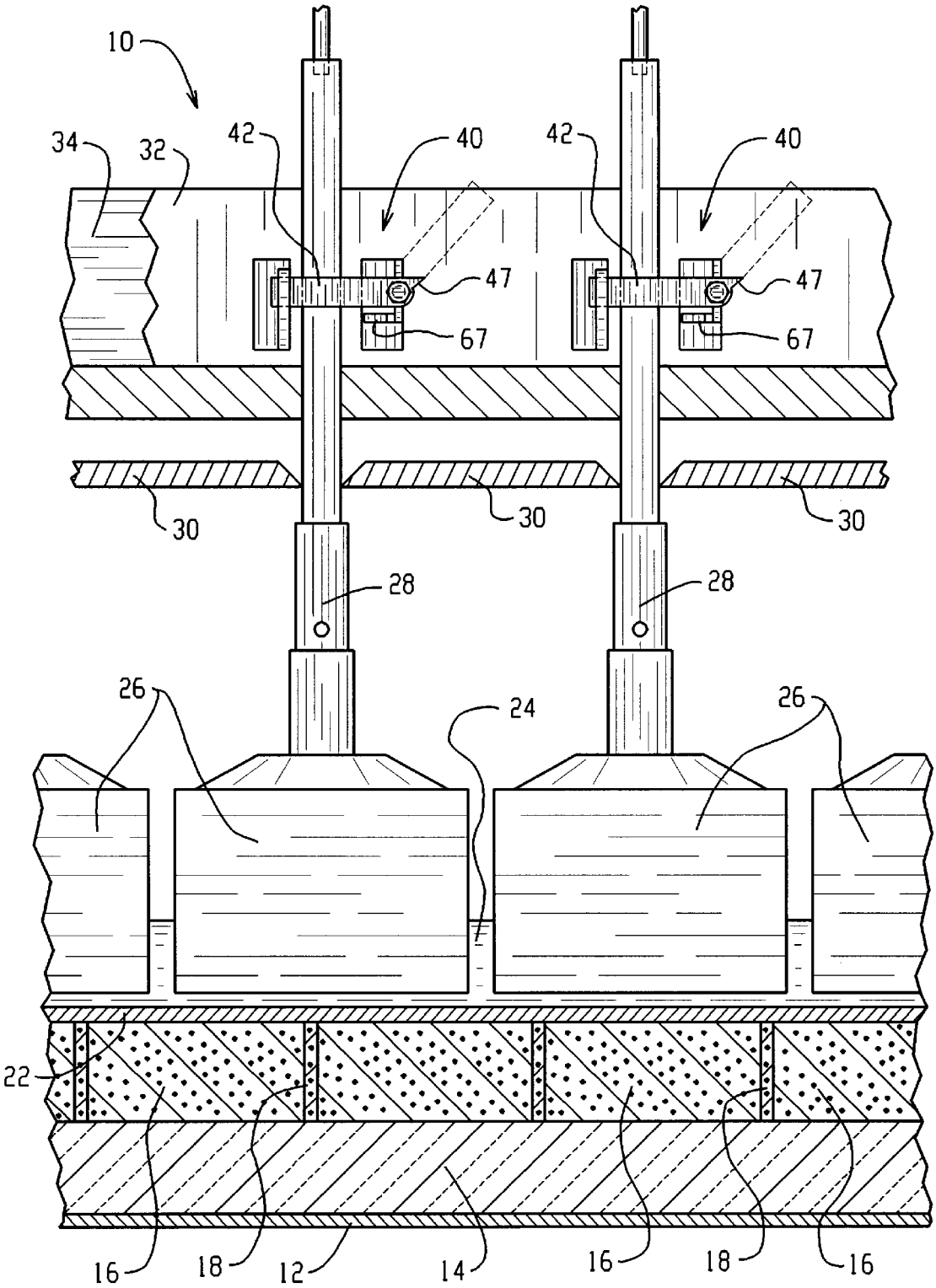
FIG. 1 (PRIOR ART)
FIG. 1 is a cutaway cross sectional elevation view of a typical prior art Hall-Heroult cell.
Figure 2:
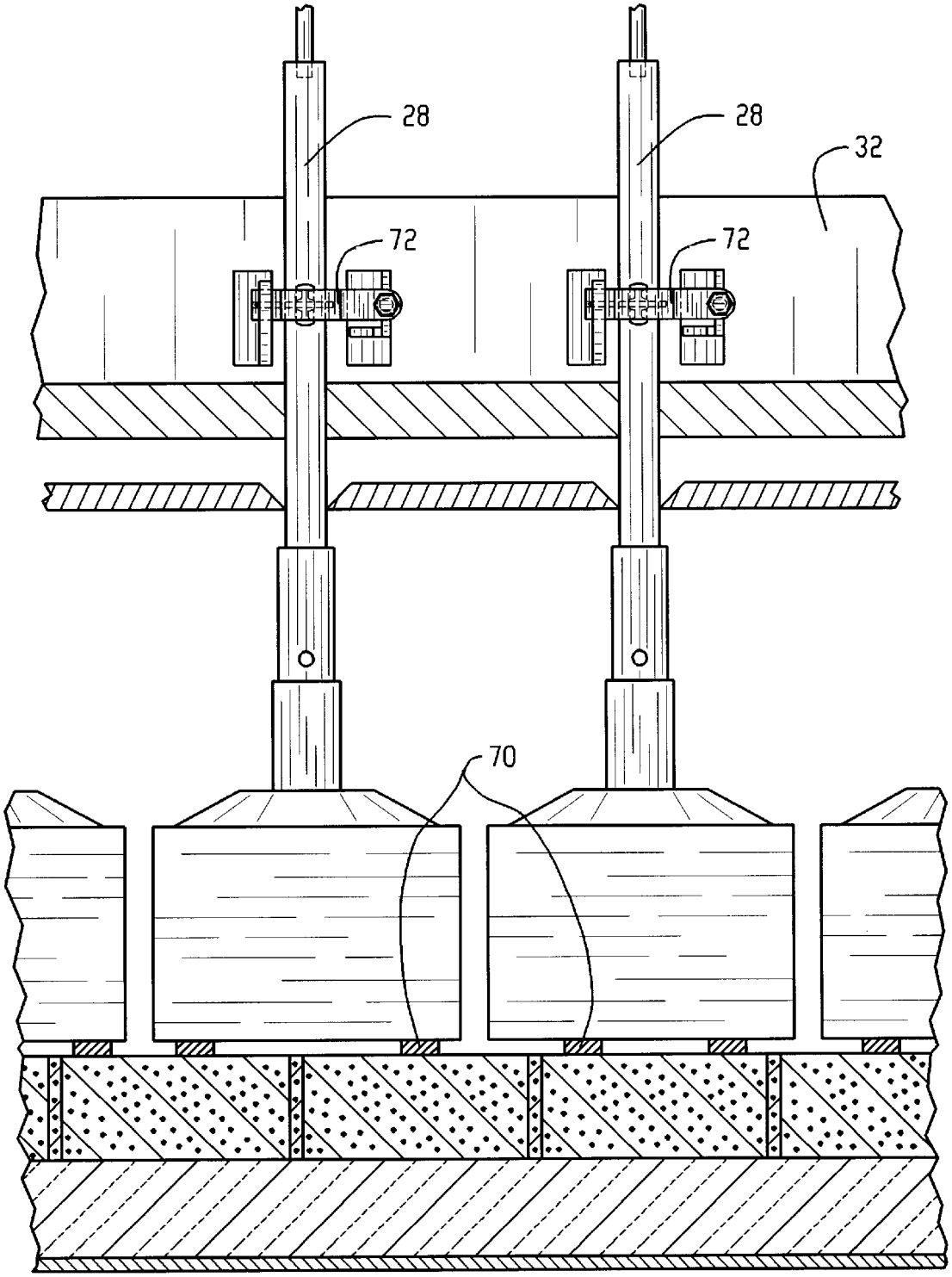
FIG. 2 is a cutaway cross sectional elevation view of the cell in FIG. 1, with a clamp embodying this invention, during the cell pre-heat cycle.
Figure 4:
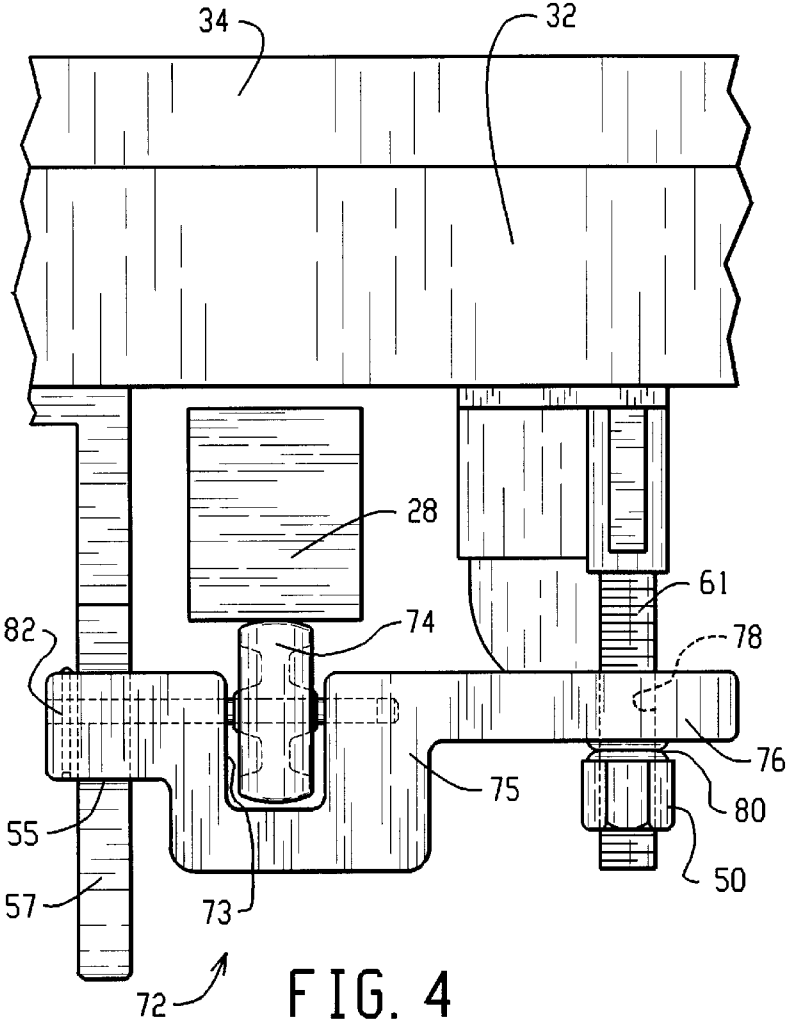
FIG. 4 is a plan view of anode support system, with a clamp embodying this invention, in the apparatus shown in FIG. 2.

The Hall-Heroult cell 10 illustrated in FIG. 1 and 2 has a steel shell 12 lined with insulation 14. Carbon cathode blocks 16 rest on the insulation. Conventional cathode collector bars (not shown) embedded in the cathode blocks 16 are connected to the negative pole of a DC electrical power supply. The joints or spaces between the cathode blocks 16 are filled with carbonaceous material 18, formed as the tamping paste used to fill gaps between the cathode blocks when they are first installed is baked and hardened during the pre-heat cycle to form a unitary cathode covering the bottom of the cell.

During normal operation of the cell, illustrated in FIG. 1, a pool of molten aluminum 22 collects above the cathode. A cryolite based bath 24 containing dissolved aluminum oxide lies on the top of the pool of molten aluminum. Carbon anode blocks 26 are suspended in cryolite bath 24 by anode support rods 28. The anode support rods 28 extend through the cell cover 30 and are connected to anode bus bar 32 by clamp assemblies, referred to generally as 40. Anode bus bar 32 and clamp assemblies 40 are attached to anode bus frame 34, which is part of a conventional cell superstructure. Holes (not shown) at the top of each anode support rod permit attachment of a crane hook to move the anode blocks, as in the replacement of individual anodes.

Figure 3:
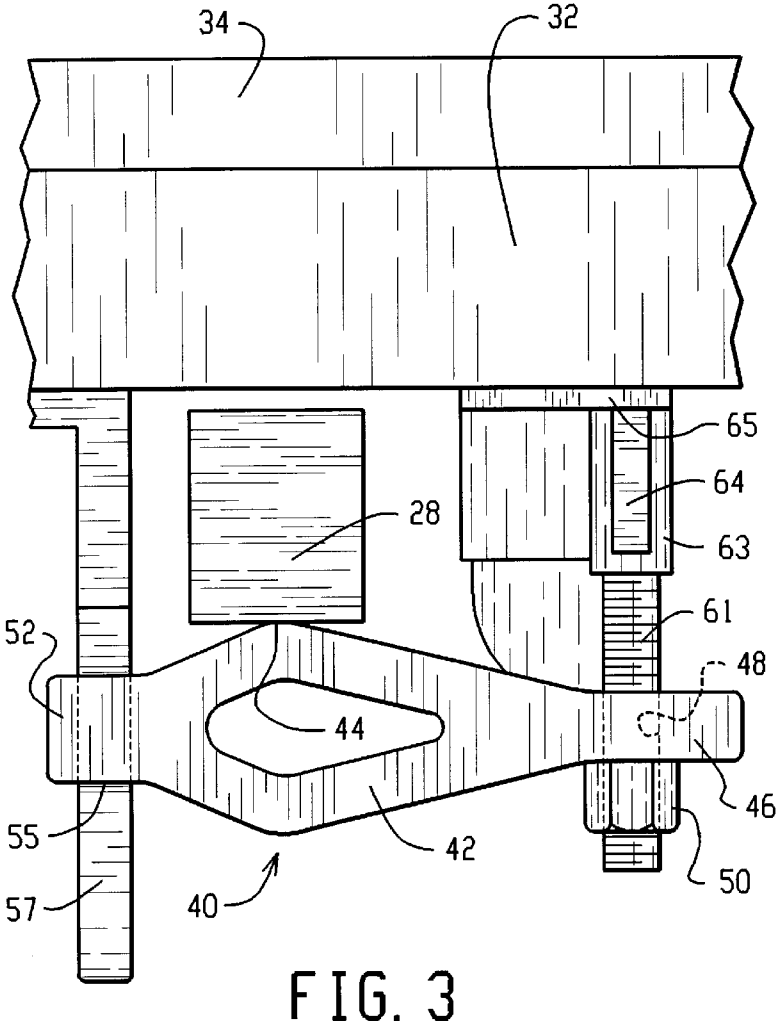
FIG. 3 (PRIOR ART)
FIG. 3 is a plan view of the anode support system employed in the apparatus of FIG. 1.
Figure 6:
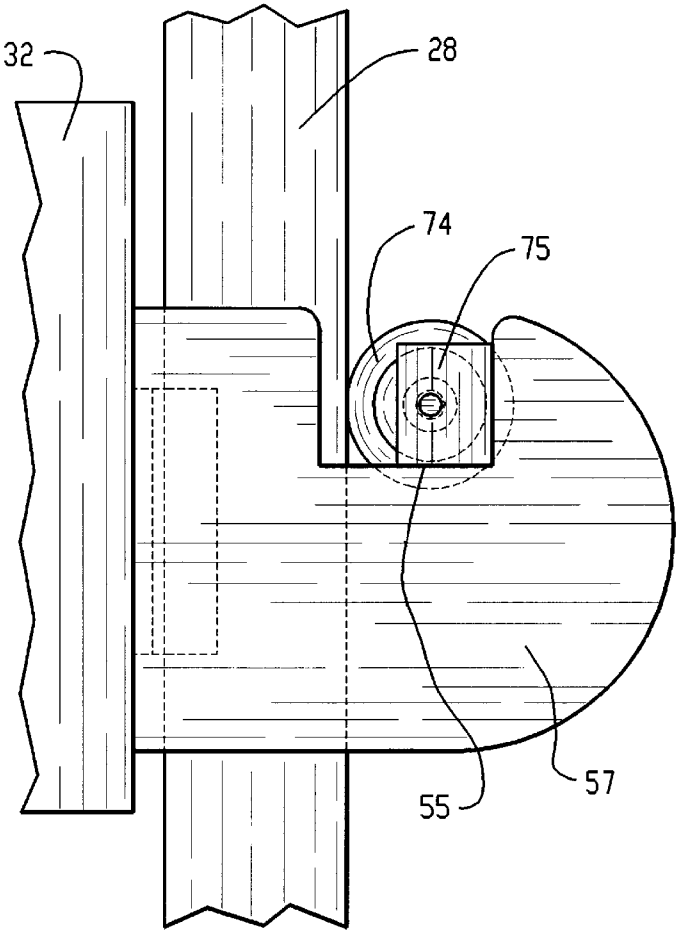
FIG. 6 is a left elevation view of the clamp in FIG. 4.
Figure 5:
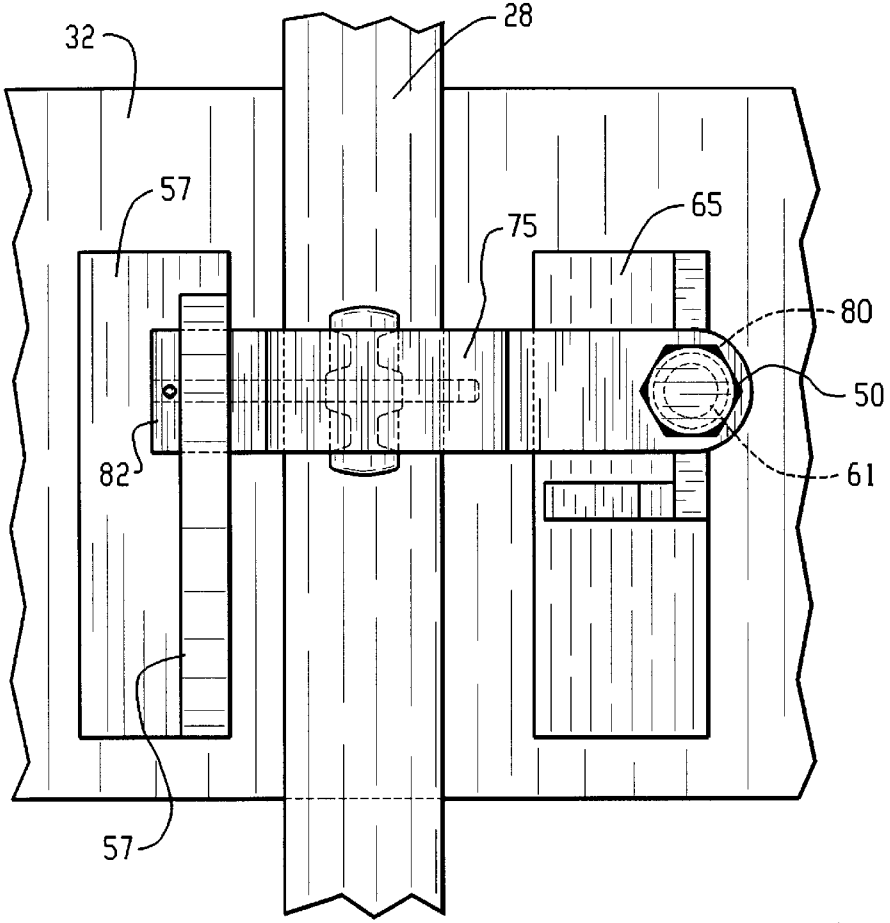
FIG. 5 is a front elevation view of the clamp in FIG. 4.

The clamp assemblies 40 are similar in many respects to the clamp assemblies disclosed in U.S. Pat. No. 4,394,242 to Clark, the disclosure of which is incorporated herein by reference. As may be seen in FIG. 3, each clamp assembly 40 includes a bar clamp 42 tapered from a central rod bearing surface 44 towards each end. One end of the clamp 42 comprises a pivot section 46, mounted on a threaded pivot rod 61 that extends through a hole 48 in pivot section 46. Clamp 42 is secured on pivot rod 61 by nut 50.

Pivot rod 61 extends from a boss 63 on mounting plate 65, which is bolted to anode bus bar 34 and anode bus frame 34. Mounting plate 65 includes vertical and lateral reinforcing ribs 64 which support boss 63, pivot rod 61 and bar clamp 42.

The other end of bar clamp 42 comprises a latching section 52. In the position illustrated in FIG. 3, and in solid lines in FIG. 1, latching section 52 is supported in the notch 55 of a clamp support 57, which is also bolted to the anode bus bar 32 and anode bus frame 34. With latching section 52 in the notch 55 of clamp support 57, the central rod bearing surface 44 of bar clamp 42 can be pressed against anode support rod 28 by tightening nut 50. When an anode is changed, the nut is loosened and clamp 42 is pivoted clockwise to the phantom position shown in dotted lines in FIG. 1. In this position the clamp 42 is supported by a contact surface 47, which engages a stop plate 67 on mounting plate 65.

During the pre-heat cycle, before the cryolite is added to the cell, the current flows from the anode blocks 26 to the cathode 16 through measured amounts of resistive carbon or coke 70 (shown in FIG. 2), which simulate the resistance between anode blocks and the cathode during normal operation. The resistive material 70 is strategically placed, being careful to avoid the seams between the cathode blocks, so that current from all anode blocks is evenly distributed to all of the cathode blocks. The coke is initially heaped on the cathode blocks in piles or rows of loose aggregate, which can then be compressed by the weight of the anode blocks.

As explained above, in order to maintain the proper resistance and proper current flow through the anode blocks and cathode blocks, it is essential that the interfacial pressure between the anode blocks 26 and resistive material 70, and between the resistive material 70 and cathode blocks 16, be kept substantially constant during the pre-heat cycle despite thermal expansion of various cell components. This invention achieves this and other objectives by replacing the bar clamps 42 of the clamp assemblies 40 shown in FIGS. 1 and 3 with the roller clamps 72 illustrated in FIGS. 2 and 4–8 for the pre-heat cycle. Roller clamp 72 is designed to fit the support mechanisms illustrated in FIG. 3, to allow roller clamps 72 and bar clamps 42 to be used interchangeably. As in the bar clamp shown in FIGS. 1 and 3, the roller clamp 72 of FIGS. 2 and 4–8 includes a latching section 82, which pivots into the notch 55 of clamp support 57, and a pivot section 76 with a hole 78 for mounting the roller clamp 72 on threaded rod 61. Unlike the conventional bar clamp 42, however, roller clamp 72 includes a roller 74, mounted in a recess 73 in roller support 75, that allows the anode support rod to move vertically and adjust for thermal expansion.

Figure 7:
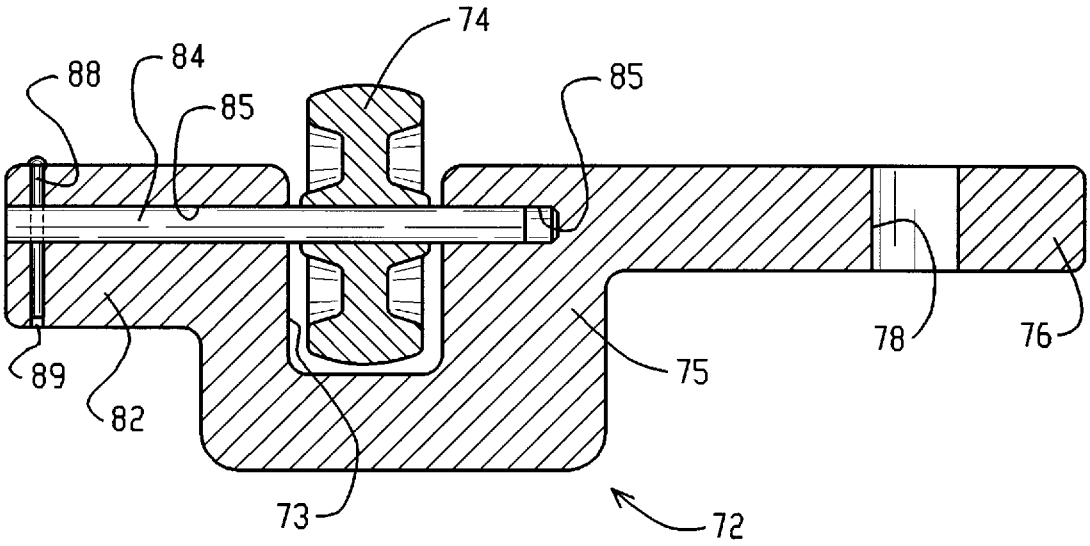
FIG. 7 is a detail view of the roller and roller support employed in the clamp of FIGS. 2 and 4–6.

As illustrated in FIG. 7, roller clamp 72 includes a roller support 75, preferably machined from aluminum alloy 6061 T-8, which provides the strength needed to transmit the forces to the anode support rod, but is light enough to be handled when changing from the roller clamps 72 to conventional bar clamps 42 at the end of the preheat cycle. The use of aluminum, which is not affected by the strong magnetic fields in Hall-Heroult cells, also makes the clamp easy to handle.

Roller 74 is preferably a solid center wheel with a slightly convex surface that produces a gradual shift in the line or area of contact between the roller and the anode support bar 28 as the roller support pivots. The roller is mounted on a rod 84 in a bore 85 in roller support 75. Bore 85 extends on both sides of recess 73. Rod 84 is secured by a pin 88 extending through a bore at 89 at the end of the roller support.

Figure 8:
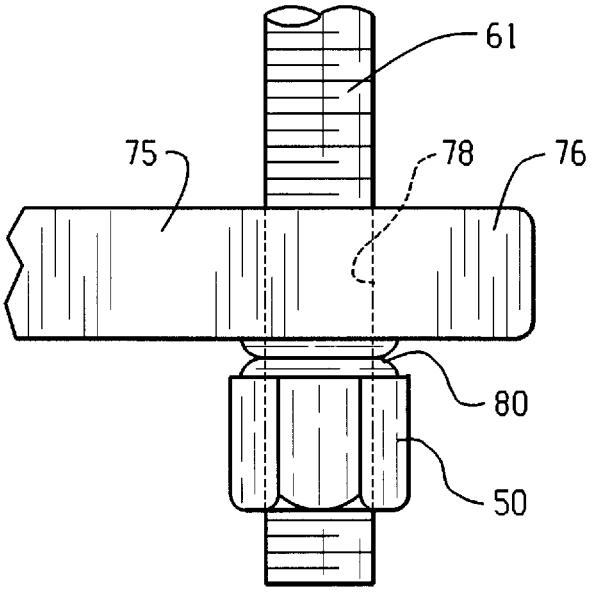
FIG. 8 is a further enlarged detail view illustrating the mounting of disk springs in the roller clamp.

Roller clamp 72 is secured on pivot rod 61 by nut 50 and one or more disk springs 80, i.e. deformable conical washers whose deflection is proportional to the applied load or, in other words, that exert a pressure that is proportional to the amount of the deflection. Preferably, two disk springs developing a force which varies from approximately 560 pounds at ¼ deflection (full deflection being the amount required to flatten the disk spring) to 1,000 pounds at ¾ deflection are mounted back-to-back, as illustrated in FIG. 8, and compressed to approximately ½ deflection. This lets the operator gauge the spring tension visually, leaves room for thermal expansion of the anode support rod, and provides a contact pressure of about 50 to 150 psi between the anode support rods 28 and anode contact buttons 36, welded to the anode bus bar 32, which provide the bearing surface for the support rods. This maintains good electrical contact, while allowing the support rods 28 to move vertically with respect to the anode contact buttons 36.

The roller clamps 72 are removed at the end of the pre-heat cycle, just before addition of the cryolite bath to the cell, and replaced by the conventional bar clamps 42, which clamp the anode support rods securely at the desired level in the bath. Thus, the rods are free to move vertically to accommodate thermal expansion during pre-heat, but are positioned securely and positively during normal operation. Replacement of the roller clamps also makes it possible to use a few roller clamps, which are more expensive than the conventional bar clamps, for restarting a much larger number of cells.

As may be seen from the foregoing description, this invention provide an effective and economical way to mount anode support bars securely for normal operation, and to allow the bars to move vertically to accommodate for thermal expansion during pre-heat. This provides more uniform contact—and a more uniform distribution of the electrical current—between the anode blocks, resistive material and cathode during pre-heat. This in turn improves bake-out efficiency and extends cell life, thereby reducing the substantial costs of rebuilding cells and of waste pot-lining disposal. The invention also greatly reduces the amount of heavy labor required to adjust anodes during the preheat cycle, which is both an economic and an ergonometric advantage.

Of course, as those skilled in the art will appreciate, a variety of modifications may be made to the preferred embodiment described above within the scope of this invention, which is defined by the following claims.

I claim:

1. In apparatus for clamping an electrolytic cell anode support against an electrical contact, the improvement wherein said clamping apparatus comprises a roller clamp having a roller and spring means to bias said roller against said anode support, and thereby bias said anode support against said electrical contact, with a pressure of about 50 to 150 psi to maintain electrical contact between said contact and said anode rod and to permit said anode support to move to accommodate thermal expansion or deflection of said anode support or of a cathode positioned to complete an electric circuit with said anode support.

2. Apparatus according to claim 1 wherein said electrical contact comprises a contact on an anode bus bar, said anode bus bar is mounted on an anode bus support, and said clamping apparatus is mounted on said anode bus support.

3. Apparatus according to claim 2 wherein said anode support comprises a rod and said roller clamp is mounted on said anode bus support for pivotal movement in a plane substantially parallel to a surface of said anode support rod on the opposite side of said anode support rod from said anode contact.

4. Apparatus according to claim 2, wherein said roller clamp is mounted for pivotal movement about a first axis on a first side of said anode support, further comprising a clamp support having a notch adapted to support a portion of said clamp remote from said first axis, said clamp support being mounted on a side of said anode support opposite to said first side, and said clamp spanning said anode support when said portion of the clamp is supported by said notch.

5. Apparatus according to claim 4 wherein said clamp is mounted for pivotal motion about a rod that extends through said clamp, and said spring means comprises one or more deformable conical disk springs mounted on said rod.

6. Apparatus to support an anode supported by an anode support rod during preheating of an electrolytic cell for the reduction of aluminum oxide to aluminum, and to permit movement to accommodate thermal expansion or deflection of one or more cell components during said pre-heat cycle, comprising an anode bus bar, an electrical contact mounted on said anode bus bar, and a clamp having a roller and at least one resilient member adapted to:

bias said anode support rod against said electrical contact with sufficient pressure to maintain an electrical connection between said anode support rod and said contact; and permit said anode support rod to move to accommodate thermal expansion or deflection of cell components.

7. Apparatus according to claim 6 wherein said resilient member is adapted to press said anode support rod against said electrical contact with a pressure of about 50 to 150 psi.

8. In an electrolytic cell, comprising a cathode, an anode bus, and a plurality of anodes supported above said cathode by anode support rods, apparatus for clamping said anode supports to said anode bus comprising a plurality of roller clamps, each of said clamps including a roller and at least one resilient member adapted to bias said roller against an anode support rod and press said anode support rod against an electrical contact on said anode bus.

9. Apparatus according to claim 8 further comprising a plurality of bar clamps and clamp supports, said bar clamps and said roller clamps being designed and adapted to fit said clamps supports, and said clamp supports being adapted to support said bar clamps or said roller clamps so that said bar clamps or said roller clamps clamp said anode support rods to said anode bus and said bar clamps can be replaced by said roller clamps during pre-heat cycles of said cell.

10. In an electrolytic cell, comprising a cathode, an anode bus, and a plurality of anodes supported above said cathode by anode support rods, apparatus for clamping said anode supports to said anode bus comprising:

a plurality of roller clamps, each of said clamps including a roller adapted to bear upon an anode support rod and press said anode support rod against an electrical contact on said anode bus;

a plurality of bar clamps, said bar clamps and said roller clamps being designed and adapted to fit said clamp supports, and said clamp supports being adapted to support said bar clamps or said roller clamps so that said bar clamps or said roller clamps clamp said anode support rods to said anode bus and said bar clamps can be replaced by said roller clamps during pre-heat cycles of said cell;

wherein said clamp supports comprise:

a mounting plate with a rod extending therefrom, said bar clamps and said roller clamps each having a pivot section with a hole extending therethrough that permits said bar clamps and said roller clamps to be mounted for pivotal movement on said rod; and a clamp support with a notch adapted to receive a latching section of a bar clamp or a roller clamp, each of said bar clamps and said roller clamps having a latching section that is designed and adapted to pivot into said notch.

11. Apparatus according to claim 10 wherein said mounting plate is mounted on a first side of said anode support rod and said clamp support is mounted on a side of said anode support rod opposite to said first side, whereby said bar clamp or said roller clamp spans said anode support rod when said bar clamp or said roller clamp is mounted on said pivot rod and the latching section of said bar clamp or said roller clamp is pivoted into said notch.

12. In a process for initiating operation of an electrolytic cell for the production of aluminum by reduction of aluminum oxide in a molten bath, said cell comprising a cathode, an anode bus having a number of anode bus contacts, and a plurality of anodes supported above said cathode by anode supports, the improvement wherein said anodes are pressed against said anode bus contacts with roller clamps and resilient members that:

bias said anode supports against said electrical contacts with sufficient pressure to maintain electrical connections between said anode supports and said contacts; and permit said anode supports to move to accommodate thermal expansion or deflection of cell components.

13. In a process for initiating operation of an electrolytic cell for the production of aluminum by reduction of aluminum oxide in a molten bath, said cell comprising a cathode, an anode bus having a number of anode bus contacts, and a plurality of anodes supported above said cathode by anode supports, the improvement wherein:

said anodes are pressed against said anode bus contacts with roller clamps that:

bias said anode supports against said electrical contacts with sufficient pressure to maintain electrical connections between said anode supports and said contacts; and permit said anode supports to move to accommodate thermal expansion or deflection of cell components; and said clamps are replaced at the end of a pre-heat cycle with bar clamps that clamp said anode support rods securely against said contact.

* * * * *

UNITED STATES PATENT AND TRADEMARK OFFICE

CERTIFICATE OF CORRECTION

PATENT NO. : 5,876,585
DATED : March 2, 1999
INVENTOR(S) : Rodney J. Schenk

It is certified that error appears in the above-identified patent and that said Letters Patent is hereby corrected as shown below:

At Claim 9, line 4, Column 6, line 41; change the word "clamps" to clamp

Signed and Sealed this

Thirty-first Day of August, 1999

*Attest:*

Q. TODD DICKINSON

*Attesting Officer*

*Acting Commissioner of Patents and Trademarks*